US011684100B2

(12) United States Patent
Baum et al.

(10) Patent No.: US 11,684,100 B2
(45) Date of Patent: Jun. 27, 2023

(54) DECORATIVE ORNAMENTATION FOR CLOTHING, FOOTWEAR AND ACCESSORIES

(71) Applicants: Asher Baum, Brooklyn, NY (US); Ari Bousbib, Monsey, NY (US); Israel Nissenbaum, Brooklyn, NY (US)

(72) Inventors: Asher Baum, Brooklyn, NY (US); Ari Bousbib, Monsey, NY (US); Israel Nissenbaum, Brooklyn, NY (US)

( * ) Notice: Subject to any disclaimer, the term of this patent is extended or adjusted under 35 U.S.C. 154(b) by 0 days.

(21) Appl. No.: 16/587,014

(22) Filed: Sep. 29, 2019

(65) Prior Publication Data

US 2020/0138133 A1 May 7, 2020

Related U.S. Application Data

(63) Continuation-in-part of application No. 16/387,022, filed on Apr. 17, 2019, now abandoned.

(60) Provisional application No. 62/659,726, filed on Apr. 19, 2018.

(51) Int. Cl.

| | |
|---|---|
| ***A41D 27/08*** | (2006.01) |
| ***A43B 23/24*** | (2006.01) |
| ***A43B 3/00*** | (2022.01) |
| *A41F 1/00* | (2006.01) |

(52) U.S. Cl.

CPC ..... *A41D 27/08* (2013.01); *A41F 1/002* (2013.01); *A43B 3/0078* (2013.01); *A43B 23/24* (2013.01)

(58) Field of Classification Search

CPC ..... A41D 27/08; A41F 1/002; A43B 3/0078; A43B 23/24; A43B 23/25; A43B 3/105; A43B 3/126; A43C 11/24

USPC ..... 2/244, 245, 246

See application file for complete search history.

(56) References Cited

U.S. PATENT DOCUMENTS

| | | | | | |
|---|---|---|---|---|---|
| 2,132,876 | A | * | 10/1938 | Myers | A43B 23/24 2/245 |
| 3,011,281 | A | * | 12/1961 | King | A43B 3/0078 36/94 |
| 3,023,420 | A | * | 3/1962 | Tann | A41B 11/001 2/239 |
| 3,596,291 | A | * | 8/1971 | Thill | A43B 3/0078 2/245 |
| 3,999,311 | A | * | 12/1976 | Epstein | A43C 11/24 36/100 |
| 4,317,292 | A | * | 3/1982 | Melton | A41B 11/007 36/9 R |
| D277,466 | S | * | 2/1985 | Chien | 63/12 |
| 4,907,350 | A | * | 3/1990 | Chilewich | A43B 9/08 12/142 A |
| 4,926,568 | A | * | 5/1990 | Coffman | A43B 1/04 36/101 |
| D312,984 | S | * | 12/1990 | Sprick | D11/213 |

(Continued)

*Primary Examiner* — Alissa L Hoey

(74) *Attorney, Agent, or Firm* — Israel Nissenbaum; Yitzy Nissenbaum

(57) ABSTRACT

A fastening element configured for attachment to a wearable clothing or accessory substrate whereby ornamental elements are configured for removable fastening thereto for changeable decorative appearance of the clothing or accessory wherein the fastening element is ornamental in appearance whereby it is aesthetically viewable with or without ornamental elements fastened thereto and whereby the fastener is able to be integrated with appearance of the ornamental element or completely hidden by the ornamental elements.

3 Claims, 9 Drawing Sheets

(56) References Cited

U.S. PATENT DOCUMENTS 4,985,968 A * 1/1991 Hooper ..... A61J 17/111 24/302
5,092,347 A * 3/1992 Shaffer ..... A61F 13/064 128/892
5,136,726 A * 8/1992 Kellin ..... A41D 27/08 2/115
5,450,658 A * 9/1995 Hicks ..... A41B 11/002 24/303
5,617,585 A * 4/1997 Fons ..... A41B 11/007 2/239
5,673,501 A * 10/1997 Mathews ..... A43B 3/0078 36/112
5,734,991 A * 4/1998 Schmid ..... A41D 27/08 2/1
5,740,557 A * 4/1998 Reid ..... A42B 1/248 2/195.1
5,800,900 A * 9/1998 Mitchell ..... A43B 1/0072 2/244
5,901,372 A * 5/1999 Lawler ..... A41D 27/20 2/115
5,901,381 A * 5/1999 Nelson ..... A41D 20/00 2/171
5,933,866 A * 8/1999 Fox ..... A41D 27/08 2/115
6,032,294 A * 3/2000 Dean ..... A41B 11/002 2/239
6,038,698 A * 3/2000 Lawler ..... A41D 27/08 2/115
6,163,938 A * 12/2000 Weber-Unger ..... A41F 1/002 24/303
6,237,158 B1 * 5/2001 Barbara ..... A41B 11/002 2/239
6,519,779 B1 * 2/2003 Taguchi ..... A42B 1/248 2/195.1
6,718,559 B1 * 4/2004 Davidson ..... A42B 3/0406 2/209.13
6,880,268 B2 * 4/2005 Chen ..... A43B 3/128 36/43
7,216,404 B1 * 5/2007 Doyle ..... A45F 5/02 206/286
7,302,712 B2 * 12/2007 Abrusia ..... A41B 11/002 2/239
7,412,785 B1 * 8/2008 Navasky ..... A43B 3/24 36/100
7,698,836 B2 * 4/2010 Schmelzer ..... A43B 3/0078 36/136
D625,502 S * 10/2010 Brambilla ..... D2/975
8,151,491 B2 * 4/2012 Sarantakos ..... A43B 3/24 36/100
8,793,846 B2 * 8/2014 d'Auriac ..... A41D 27/08 24/303
9,089,169 B1 * 7/2015 Covo ..... A41D 1/04
9,277,775 B2 * 3/2016 Lopez ..... A41F 9/00
9,609,924 B1 * 4/2017 Silverman ..... A43B 23/24
9,675,138 B2 * 6/2017 Mazzarolo ..... A43C 13/14
9,955,757 B1 * 5/2018 Ng ..... A44B 17/0082
10,098,416 B1 * 10/2018 Harvey ..... A43B 23/24
10,470,531 B1 * 11/2019 Yanes ..... A42B 1/24
10,633,787 B1 * 4/2020 Pham ..... D06F 95/008
2004/0093765 A1 * 5/2004 Baldwin ..... A43B 3/103 36/101
2006/0162051 A1 * 7/2006 Bachechi ..... A41D 27/08 2/338
2007/0167106 A1 * 7/2007 Hoover ..... A41F 1/002 446/26
2007/0266596 A1 * 11/2007 Mann ..... A43B 3/122 36/50.1
2008/0034478 A1 * 2/2008 Patterson ..... A41B 11/002 2/239
2008/0060110 A1 * 3/2008 Schmelzer ..... A43B 3/0078 2/69
2008/0271348 A1 * 11/2008 Fromm ..... A43B 1/0054 36/136
2008/0276492 A1 * 11/2008 Burnett ..... A43C 11/22 36/51
2009/0013449 A1 * 1/2009 Kahn ..... A61J 17/111 2/209.13
2009/0025259 A1 * 1/2009 Sack ..... A43B 3/0078 36/136
2009/0300948 A1 * 12/2009 Nordstrom-Wehner ..... A43B 3/0078 36/136
2010/0011623 A1 * 1/2010 Seckier ..... A43B 1/0054 36/136
2010/0122474 A1 * 5/2010 Wolf ..... A43B 3/0078 36/100
2011/0041363 A1 * 2/2011 Stanfield ..... A43B 1/0054 36/11.5
2011/0061207 A1 * 3/2011 Forbes ..... A41D 27/08 24/104
2011/0145971 A1 * 6/2011 Norbert ..... A43B 3/0078 2/85
2011/0167597 A1 * 7/2011 Su ..... A41F 1/002 24/303
2012/0015120 A1 * 1/2012 Haegele ..... A43B 3/0078 428/34.1
2012/0137409 A1 * 6/2012 Chrysostom ..... A44B 17/0082 2/244
2012/0144562 A1 * 6/2012 Ferrara ..... A41D 27/08 2/338
2012/0186109 A1 * 7/2012 Vanderbeek ..... A43B 3/242 36/136
2012/0192460 A1 * 8/2012 Barnhart ..... A43B 23/24 36/136
2012/0272434 A1 * 11/2012 VanNostran ..... A41D 27/08 2/244
2013/0042391 A1 * 2/2013 Hill ..... A45C 13/08 2/244
2013/0174327 A1 * 7/2013 Baum ..... A43B 1/0027 2/245
2013/0273304 A1 * 10/2013 Blue ..... B32B 3/06 428/99
2013/0302558 A1 * 11/2013 Schoenbeck ..... A41D 19/0034 428/99
2013/0312160 A1 * 11/2013 Spencer ..... A41F 1/002 2/244
2014/0053319 A1 * 2/2014 Cho ..... A42B 1/248 2/209.13
2014/0090149 A1 * 4/2014 Zuiderveen ..... A41B 11/002 2/239
2014/0359919 A1 * 12/2014 O'Leary ..... A44C 3/001 2/244
2015/0017871 A1 * 1/2015 Deane ..... A61J 17/111 446/227
2015/0020414 A1 * 1/2015 Mulholland ..... A43B 5/001 36/100
2015/0033584 A1 * 2/2015 Ferguson ..... A43B 3/244 36/103
2015/0082832 A1 * 3/2015 Mencagli ..... A44B 1/32 63/40
2015/0096109 A1 * 4/2015 Nackowski ..... A43B 23/24 2/245
2015/0143724 A1 * 5/2015 Rivera ..... A43B 23/24 36/72 R
2015/0374055 A1 * 12/2015 Kim ..... A41D 13/0007 2/244
2016/0015101 A1 * 1/2016 Stefanovic ..... A41D 27/08 2/244
2016/0021983 A1 * 1/2016 Chapin ..... A43B 3/103 24/453
2016/0081431 A1 * 3/2016 Ebadi ..... A43B 3/0078 36/138
2016/0286894 A1 * 10/2016 McNamara-Schwartz ..... A43B 23/24
2017/0164682 A1 * 6/2017 Pianta ..... A43B 3/24
2017/0196344 A1 * 7/2017 Nakamura ..... A43B 23/24
2017/0224055 A1 * 8/2017 Hooper ..... A43B 1/0054

(56) References Cited

U.S. PATENT DOCUMENTS

| | | | | |
|---|---|---|---|---|
| 2017/0238641 | A1* | 8/2017 | Chapman | A61J 17/1115 |
| 2017/0265569 | A1* | 9/2017 | Reid | A43B 23/24 |
| 2018/0168254 | A1* | 6/2018 | Pandolfino | A44B 11/266 |
| 2018/0184752 | A1* | 7/2018 | Theisen | A43C 11/24 |
| 2019/0289925 | A1* | 9/2019 | Jones | A41F 1/002 |
| 2019/0313745 | A1* | 10/2019 | Puglia | A44B 1/06 |
| 2021/0127779 | A1* | 5/2021 | Haehn | A43B 3/0078 |

* cited by examiner

Fig. 1
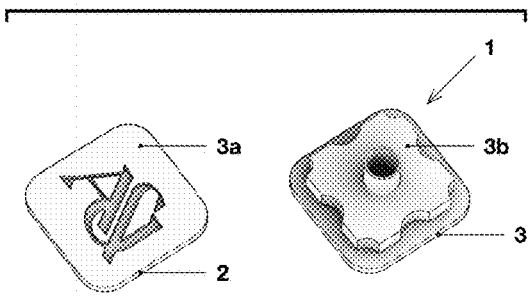
Fig. 2A
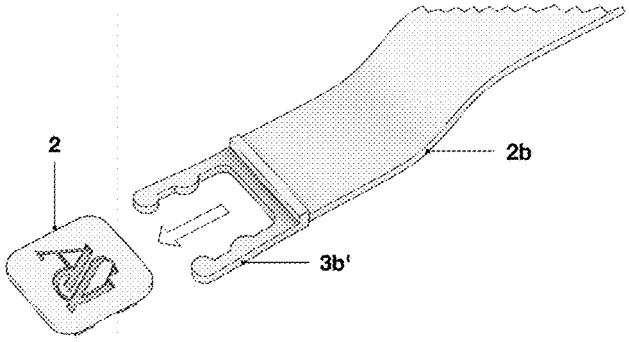
Fig. 2B
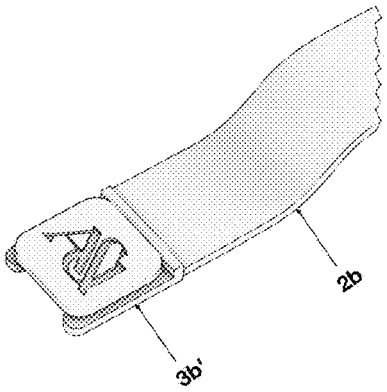
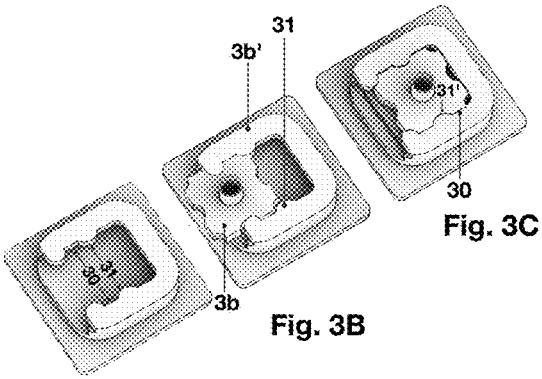
Fig. 3C
Fig. 3B
Fig. 3A

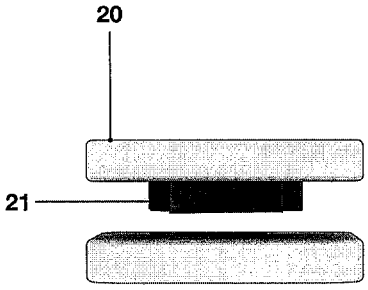
Fig. 4A
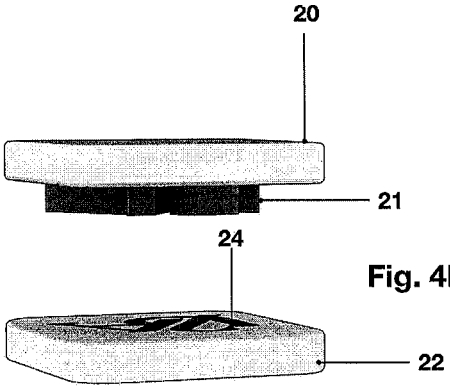
Fig. 4B
Fig. 5A
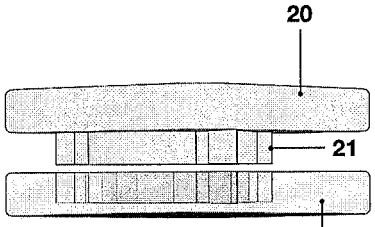
Fig. 5B
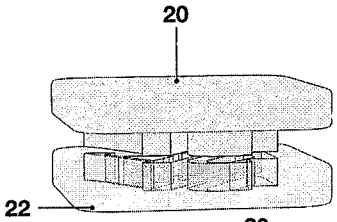
Fig. 5C
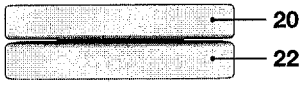
Fig. 5D
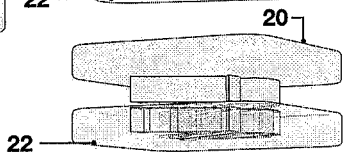
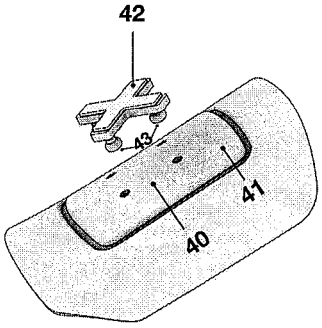
Fig. 6A
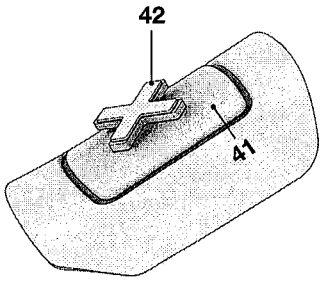
Fig. 6B Fig. 20
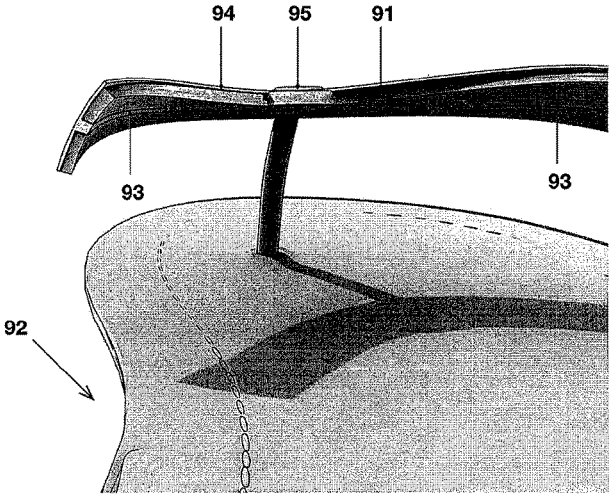
Fig. 21
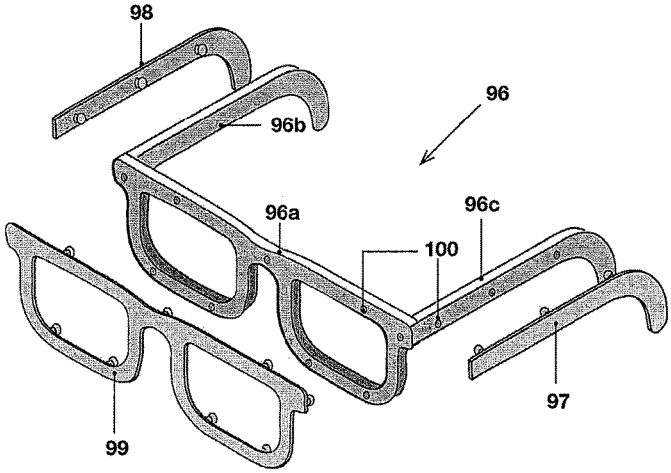
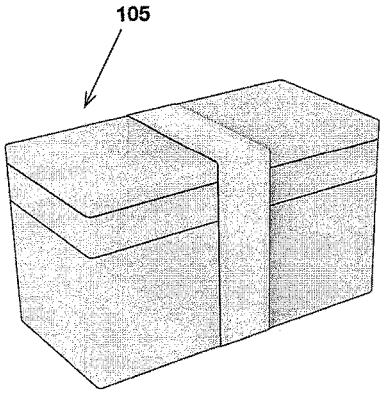
Fig. 22A
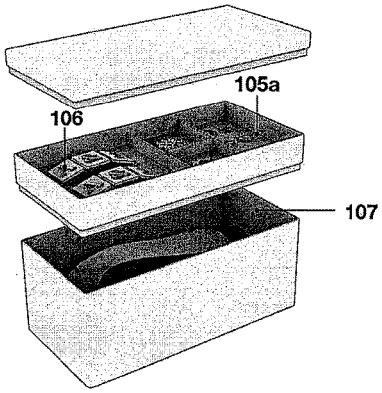
Fig. 22B

DECORATIVE ORNAMENTATION FOR CLOTHING, FOOTWEAR AND ACCESSORIES

This is a continuation in part of application Ser. No. 16/387,022 filed Apr. 17, 2019 which, in turn, claims priority from provisional application No. 62/659,726 filed Apr. 19, 2018, the disclosures of which are included herein in their entirety by reference thereto.

FIELD OF THE INVENTION

This invention relates to decorative elements for clothing, footwear, caps and accessories such us eyeglasses, handbags and back packs and the like, and more particularly relates to interchangeable decorative elements and fastening elements.

BACKGROUND

Decorative or ornamental elements affixed to clothing and caps and particularly footwear are known and have been utilized for some years. In particular interchangeable decorative or ornamental elements are known such as described in the current applicant's own U.S. Pat. Nos. 8,387,284 and 8,667,712. In many instances the decorative or ornamental elements are passive and flat depictions of scenes, logos, designs and the like. The affixation element is usually a clip or similar type of fastener with a non-decorative utilitarian appearance and is invariably aesthetically covered during wearing of the clothing or footwear and provides a no aesthetic appearance in the absence of being, covered. This is more apparent with respect to ornamental devices and fasteners used with accessory items such as eyeglasses, purses and pocketbooks, backpacks and the like. In addition, except for lighting elements in children's shoes and sneakers, ornaments are generally unchanging without decorative vibrancy.

SUMMARY

It is an object of the present invention to provide a changeable ornamentation system for clothing, footwear, caps, accessories and the like wherein the fasteners used to effect a connection between an ornament and a base object such as a shoe, article of clothing or accessory do not have a visual appearance as utilitarian fasteners and are, in themselves ornamental;

It is a further object of the invention to provide the fasteners as being integrable with other elements to provide an overall ornamental appearance including the fastener with the fastener remaining ornamentally visible with affixation of an ornamental element or wherein, in the absence of a fastened ornamental element, the fastener is specifically ornamental.

It is still another object of the invention in provide a method of decorating an article of clothing or accessory with an ornamental fastening element which can be ornamentally used without other ornaments or which is configured to be displayed with attached ornaments or which is completely hidden by other ornaments.

It is yet another object of the invention to provide animated and app driven decorative elements for ornamental integration with the ornamental fastener.

Generally, the present invention comprises an ornamental fastening system and method of ornamentation with a fastener element, affixed to a clothing or accessory substrate, is configured for the removable fastening thereto of ornamental elements and wherein the fastening element is itself configured to be visually ornamental whereby the fastening element provides an ornamental appearance in the absence of an ornament element adapted to be affixed thereto. In addition, the ornamental fastener is thereby able to be integrated with the ornamental elements to an extent whereby it remains in whole or in part externally ornamentally visible. In an embodiment of the invention concealed structures of the ornamental fastener provide a fastening interaction with corresponding elements in an ornamental element such as with a laterally inserted engagement such as with a releasable détente fastening action. In another embodiment the face of the ornamental fastener element is three dimensionally shaped to correspondingly co-fit with a base of an ornamental element such as with a vertical detent fastening and/or a non-planar magnetic fastening. In a further embodiment, a fastening element is configured to be a palette for the affixation thereto of multiple separate ornamental elements of for the multiple point affixation of a single large ornamental element. In another embodiment an aesthetic ridge type element is engageable with an ornament having concealed ridge engaging elements which engage the ridge with a concealed fastening connection.

The above and other objects, features and advantages of the invention will become more evident from the following discussion and drawings in which:

SHORT DESCRIPTION OF THE DRAWINGS

FIG. 1 depicts a first embodiment of an ornamental separable fastening element with the ornamental portion shown as being removed for viewing of the fastening portion thereof;

FIG. 2A shows the assembled fastener of FIG. 1 as being engaged with a co-fitting fastener integrated with a strap ornament;

FIG. 2B depicts the completed engagement between the fastener and the strap ornament of FIG. 2A;

Figure 9A:
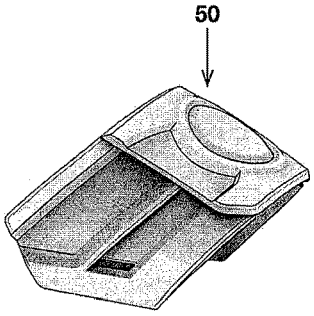
Figure 9B:
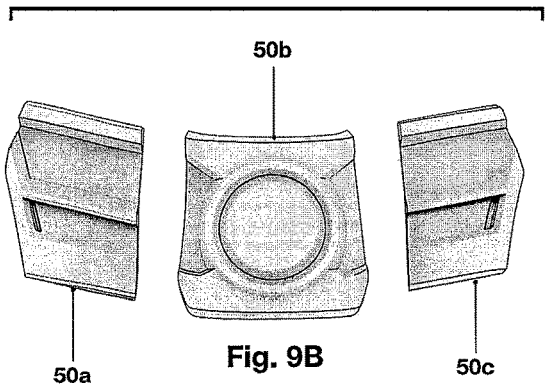
Figure 9C:
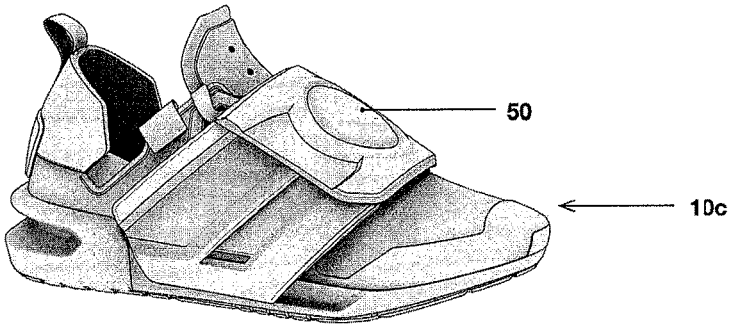
Figure 10A:
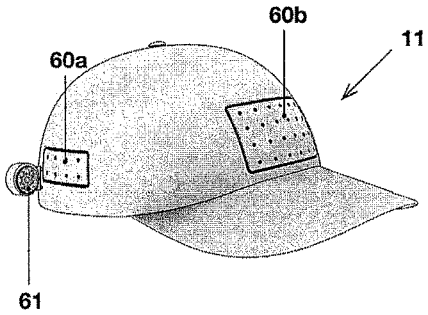
Figure 10B:
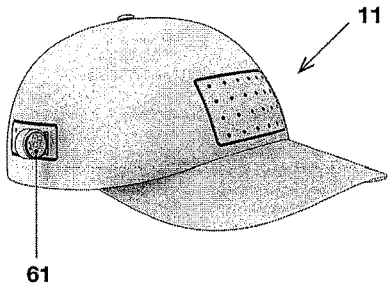
Figure 10C:
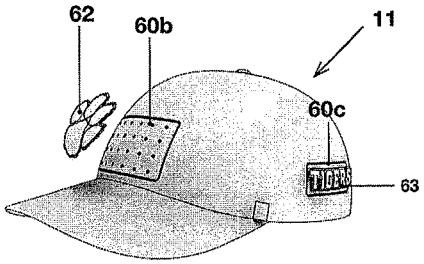
Figure 10D:
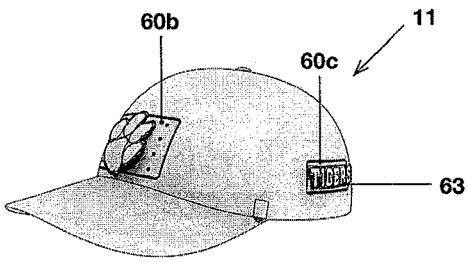
Figure 11A:
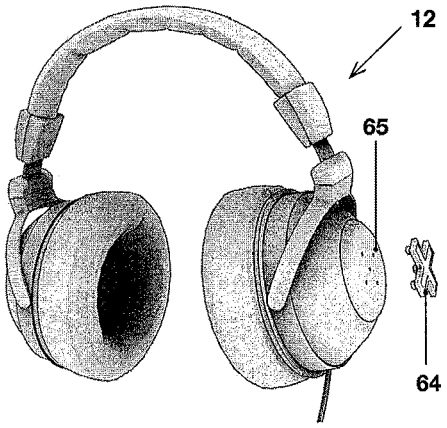
Figure 11B:
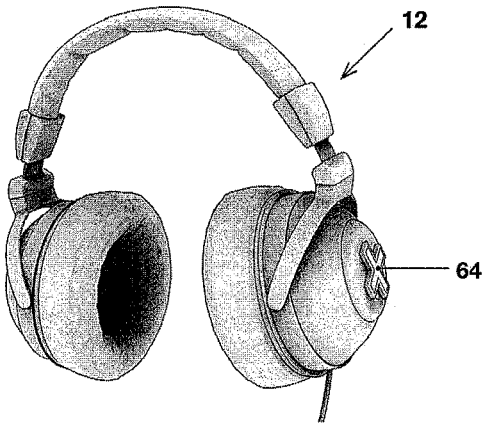
Figure 12A:
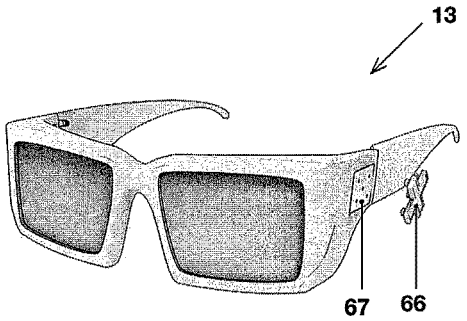
Figure 12B:
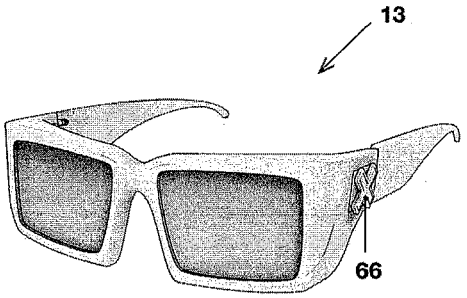
Figure 13A:
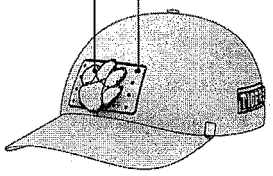
Figure 13B:
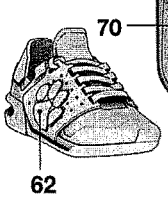
Figure 13C:
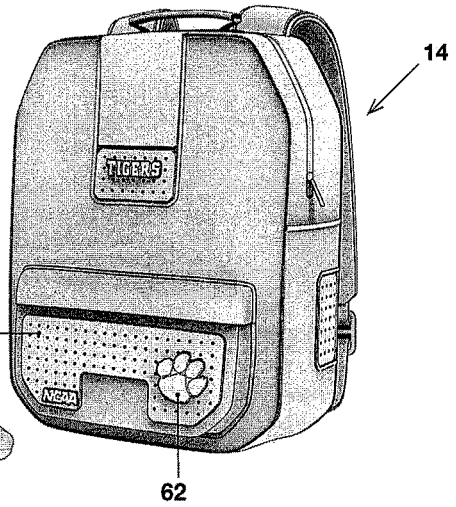
Figure 16A:
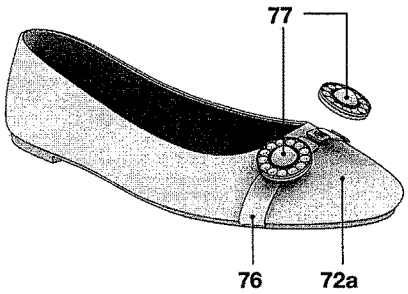
Figure 16B:
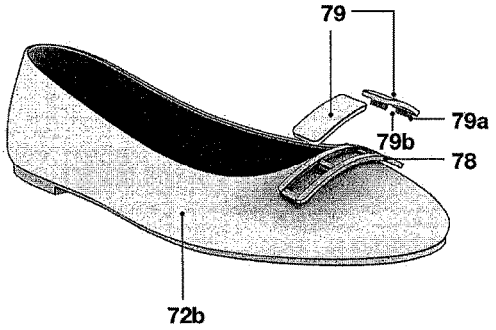
Figure 17A:
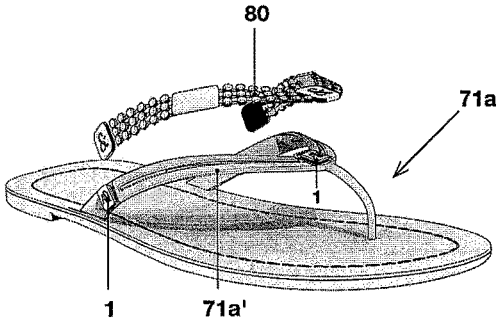
Figure 17B:
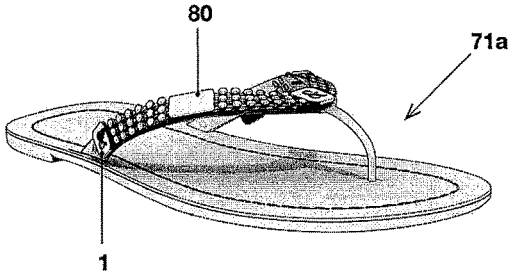
Figure 18A:
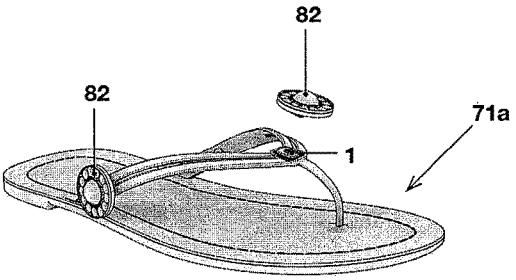
Figure 18B:
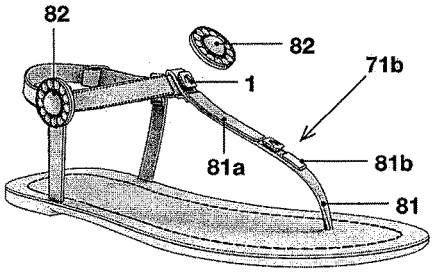
Figure 19A:
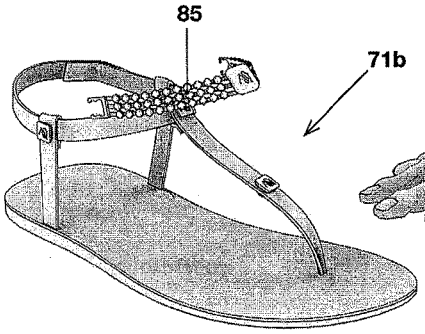
Figure 19B:
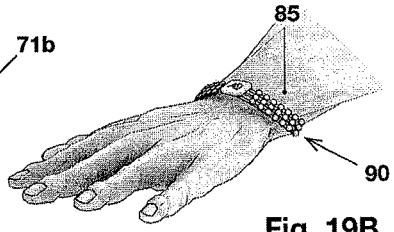
Figure 23A:
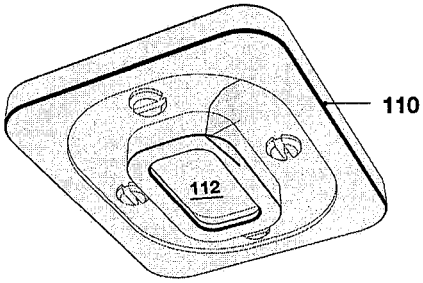
Figure 23B:
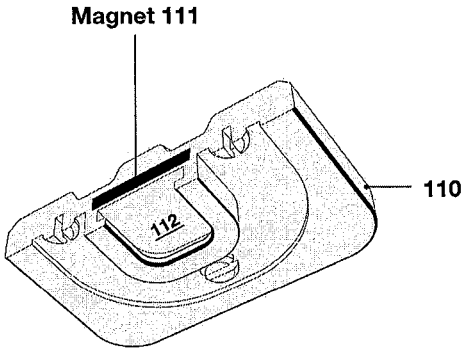
Figure 24C:
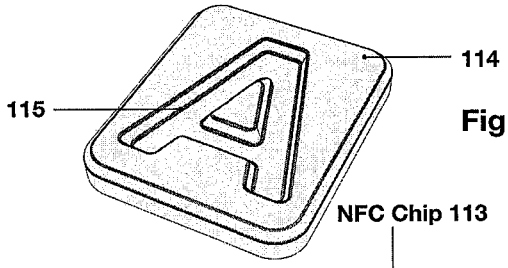
Figure 24A:
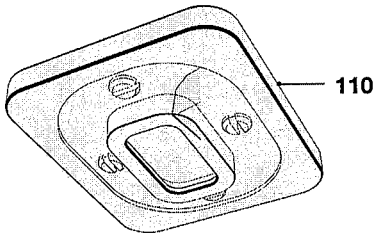
Figure 24B:
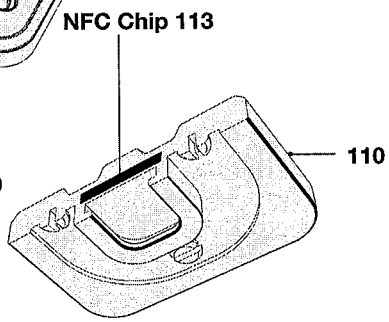
Figure 25:
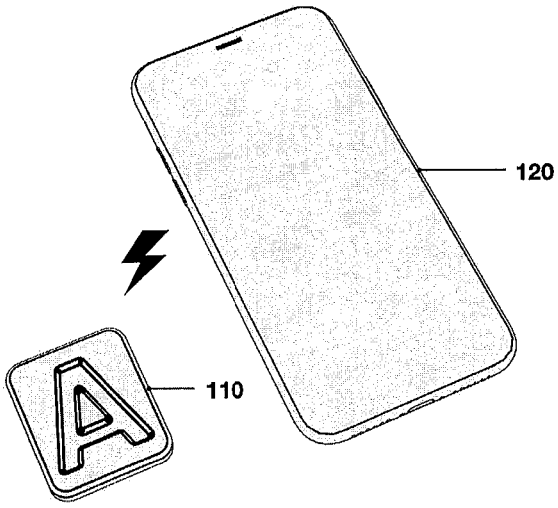

FIGS. 3A-C show, in a cutaway view, the detent separable engagement mechanism and operation of the fastening element of FIGS. 2A and 2B;

FIGS. 4A, 4B and 5A-D show various side and perspective views of a second embodiment of an ornamental separable fastening element with cooperative nesting elements embossment fastening engagement;

FIGS. 6A and 6B show an ornament with pegs being fitted onto a decorative pegboard base;

FIGS. 7A-D show a sneaker with a decorative pegboard base similar to that of FIGS. 6A and 6B with a large ornament fastened thereto (FIGS. 7A and 7B) and with several ornaments fastened thereto at different positions as a montage (FIGS. 7C and 7B): FIGS. 8A-C show fastening of an ornament to a pegboard on a heel of a sneaker and an ornamental "high top" to a sneaker respectively;

FIG. 9A is a composite ornament shown in segmented pans in FIG. 9B and as affixed to the pegboard of a sneaker as shown in FIG. 9C;

FIGS. 10A-D show the affixation and fastening of various ornaments to pegboards on a cap:

FIGS. 11A, 11B and 12A, 12B depict fastening affixation of ornaments to pegboards on headphones and eyeglasses respectively:

FIGS. 13A-C show the same ornaments being interchangeably fastened to pegboards on a cap, sneaker and a back pack respectively;

FIGS. 14A, 14B and 15A, 15B show a sandal and woman's shoe respectively each with a decorative ridge and an ornament with clip base firmly but removably engaged with the respective ridges;

FIGS. 16A and 16B show a woman's ballerina shoe with a hand having several ornamental fasteners as shown in FIG. 1 and with an open metal band with friction fit ornaments respectively;

FIGS. 17A and 17B show a V-sandal with a V shaped extended ornament being fastened to the V shaped upper strap with multiple fasteners, as shown in FIG. 1;

FIGS. 18A and 18B show a V-sandal and a T-sandal with fastened ornaments respectively;

FIGS. 19A and 19B show a bracelet ornament being fastened to a sandal and as a bracelet on a wrist respectively;

FIG. 20 shows a sandal with a strap bracing element to prevent sagging;

FIG. 21 illustrate a pair of eyeglass with pegboard attachment of ornamental temples and frame elements;

FIGS. 22A and 22B shows a shoe box as closed and as opened respectively with a tray partitioned for storage holding of ornaments for use with the shoe also contained therein;

FIGS. 23A and 23B show another fastening embodiment with a magnet being imbedded within an ornament;

FIGS. 24A-C show an ornamental element with an imbedded NFC chip and a screen showing an ornamental letter; and FIG. 25 shows a smartphone in communication with the NFC chip-containing ornament shown in FIGS. 24A-C to selectively control the visual appearance of the ornament.

DETAILED DESCRIPTION

With reference to the drawings, FIGS. 1-4 depict an ornamental fastening structure 1 comprised of a removable ornamental element 2 and an ornamental base fastening element 3. The ornamental base element 3 is affixed to a sibstratc such as a sneaker 10 in FIG. 7A through FIG. 9B. Other exemplary and non-limiting substrates include tire cap 11 in FIGS. 10A-D and 13A; the headphone 12 of FIGS. 11A and 11B; eyeglasses 13 of FIGS. 12A and 12B; and backpack 14 of FIG. 13C as well as sundry shoes and sandals shown in other figures.

The fastening elements shown in the figures all embody base fastening elements which provide independent ornamental appearance whether with or without additional ornamental elements. This independent ornamental appearance is achieved in the ornamental base element 3 of FIGS. 1-4 with a base structure comprised of an outwardly visible section 3*a* and a detent structure 3*b* beneath the ornamentally visible section 3*a* which is laterally accessible. As shown in FIGS. 2A and 2B ornamental strap 2*b* includes an integral detent structure 3*b*' configured to engage and removably lock with base detent structure 3*b*. Sequential FIGS. 3A-C show, in cutaway view, engagement of indents 30 with protrusions 31. Rounded edges 31' of the protrusions facilitate engagement and disengagement movements. Base detent structure 3*b* is fully symmetrical whereby lateral engagement of the detent structure with ornament detent structure 3*b*' front any direction.

In another embodiment, FIGS. 4A and 4B and FIGS. 5A-D show ornamental base elements 20 with raised ornamental features 21. Ornamental elements 22 include underside recesses 24 configured to fit onto raised features 21 with an engaging frictional fit. Magnetic elements are optionally included in the ornamental base and the ornamental elements to ensure secure fastening.

FIGS. 6A and 6B illustrate a further embodiment with a pegboard configuration 40 in the base element 41 to provide it with an ornamental appearance. It is noted that the pegboard configuration does not embody through holes. Ornamental element 42 is provided with pegs 43 configured to align with and fit into pegboard 40 of base element 41.

Figure 7A:
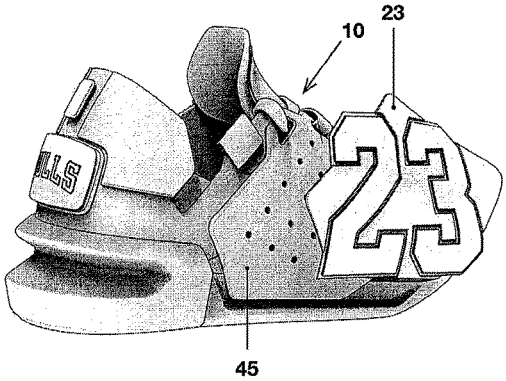
Figure 7B:
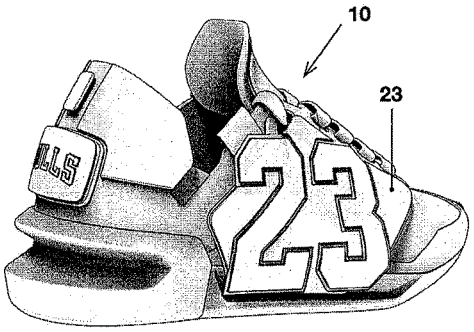
Figure 7C:
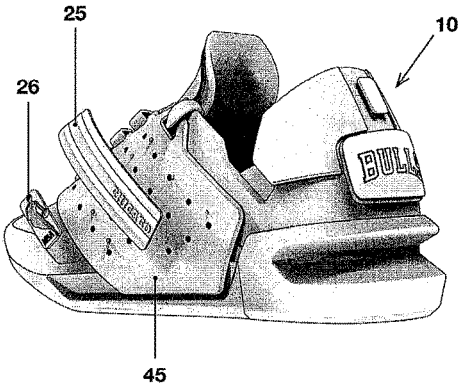
Figure 7D:
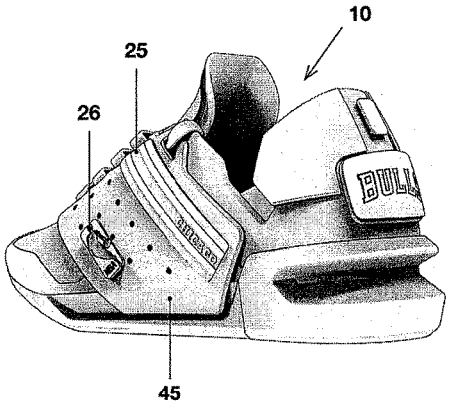
Figure 8A:
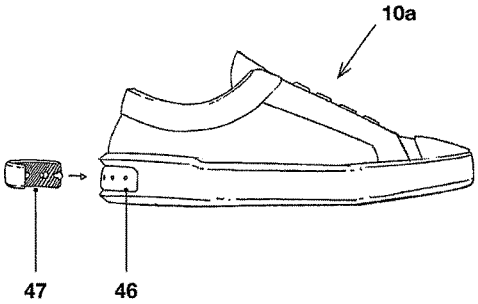
Figure 8B:
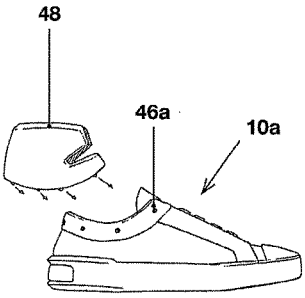
Figure 8C:
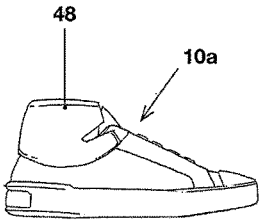

Sneaker 10 in FIGS. 7A and 7B shows a large ornament 23 fitted to and fastened to ornamental pegboard 45. Ornaments 25 and 26 are shown in FIGS. 7C and 7D as being affixed and fastened to ornamental pegboard 45 at different selected positions. In FIG. 8A sneaker 10*a* is provided with a heel positioned ornamental pegboard 46 to which ornamental 47 is affixed and fastened. A high top element 48 is shown in FIGS. 8B and 8B as being affixed to sneaker 10*a* at ornamental pegboard 46*a*.

A further utilization of the pegboard configuration is shown by the composite ornament 50 in FIG. 9A comprised of separate element 50*a*, 50*b* and 50*c* in FIG. 9B and as affixed in close juxtaposition to sneaker 10*c* in FIG. 9C.

Cap 11, as shown in FIGS. 10A-D, has pegboard elements 60*a*-*c*, to which ornamental elements 61, 62 and 63 are affixed. Similarly, ornament 64 is affixed to ornamental pegboard 65 on headphone 12, in FIGS. 11A and B, and ornament 66 to pegboard 67 on eyeglasses 13 in FIGS. 12A and B.

The same ornament 62 is shown in FIGS. 13A-C as being affixed to pegboards 60*b* on cap 11, on pegboard 45 on sneaker 10 and on pegboard 70 of back pack 14

Figure 14A:
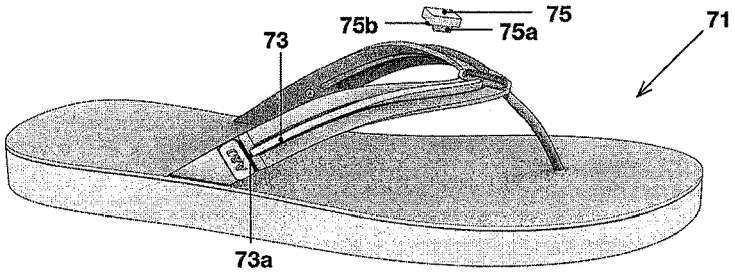
Figure 14B:
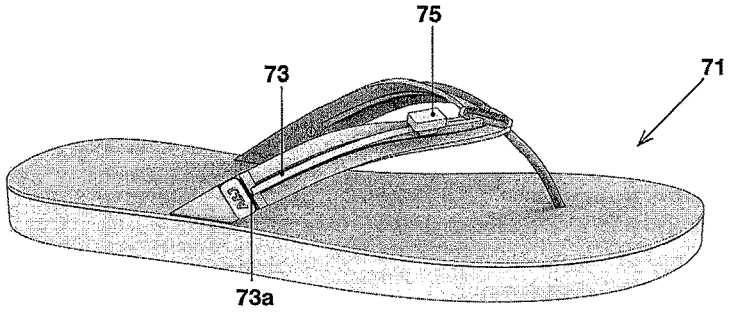
Figure 15A:
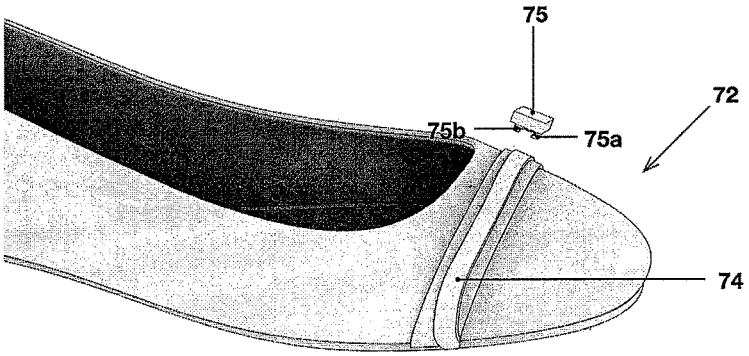
Figure 15B:
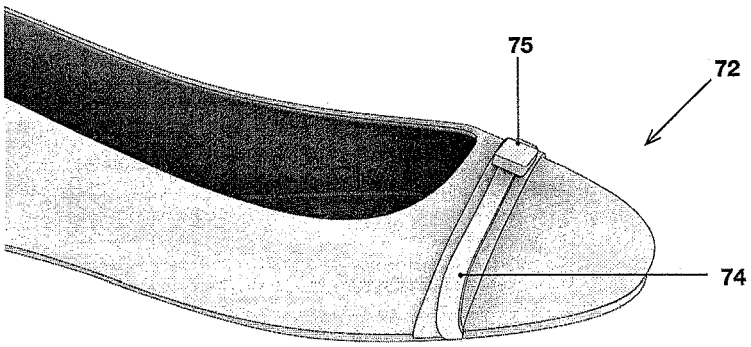

The V-sandal 71 of FIGS. 14A, 14B and the ballerina shoe 72 of FIGS. 15A, 15B illustrate the utilization of decorative ridge elements 73 and 74 respectively as ornamental fastening bases. Ornament 75 includes pincer prongs 75*a* and 75*b* which engage and hold onto the resilient ridge elements 73 and 74 respectively at selected sites. Where the ridge element 73, as in FIGS. 14A and 14B, has an accessible end 73*a*, the prongs 75*a* and 75*b* can slide onto the ridge and be subsequently held against vertical removal by an undercut engagement with the base of the ridge element 73.

The ballerina shoe 72*a* in FIG. 16A has a supporting band 76 onto which ornamental base fasteners 1 of FIG. 1 are fixedly positioned. Ornaments 77 with cooperative engaging structures as in FIG. 3A-C are positioned on the base fasteners 1 with a slide-on engagement from any direction. Ballerina shoe 72*b* in FIG. 16B is provided with decorative open metal band 78 into which spring tensioned prongs 79*a* of ornaments 79 are fitted with a secure fastening.

FIGS. 17A and 17B show a V-sandal 71*a* with a V shaped extended ornament 80 being fastened to the V shaped upper strap 71*a*' with multiple (two ends and a central position) ornamental fasteners 1, as shown in FIG. 1.

FIGS. 18A and 18B show V-sandal 71*a* and a T-sandal 71*b* with ornaments 82 fastened respectively onto the ornamental fasteners 1. Ornaments 82 (when fastened, as shown) and ornamental fasteners 1 are shown as outwardly facing in the same direction to provide alternative first and second ornamental appearances. In FIG. 18B, raised element 81*a* and 81*b* of T-strap 81 enhance the ornamental appearance of the ornamental fasteners 1, in the absence of any attached ornaments.

FIGS. 19A and 19B show a bracelet ornament 85 being fastened to T-sandal 71*b* and as a bracelet 85 on a wrist 90 respectively.

Sandal strap 91 of sandal 92 is shown in FIG. 20 with groove cutouts 93 for fitment therein and on the outer surface of the strap 91 with a strap bracing element 94 integrated with central element 95 as a means to prevent sagging of the strap 91, particularly when the sandal is being displayed.

FIG. 21 illustrate a pair of eyeglass 96 with the frame 96*a* and the temples 96*b* and 96*c* are provided with decorative apertures 100 for pegboard attachment of ornamental temples 97 and 98 and frame element 99.

As a specially designed container, FIGS. 22A and 22B show a modified shoe box 105, as closed and as opened respectively with a tray 105*a* partitioned for storage holding of ornaments 106 of various sizes for use with the shoes 107 also contained therein.

FIGS. 23A and 23B show another fastening embodiment with a magnet 111 (shown in cutaway) as being imbedded within an ornament 110. Central recessed section 112 is configured to interfit with a decorative protrusion in an ornamental base element (not shown) having a corresponding attracting element such as metal or another magnet to effect a secure hut removable attachment.

FIGS. 24A-C show an ornamental element 110 with an imbedded NFC chip 113 and a screen 114 showing an ornamental letter 115. As shown in FIG. 25 a smartphone 120 is in communication with the NFC chip-containing ornamental element to selectively control, typically via an app, the visual appearance of the ornament 110. Other common near field communication methods and elements such as RFID and Bluetooth can be used to similar effect.

It is understood that the above description and drawings are merely illustrative of the invention with other ornamental fastening methods and structures and the like as well as other substrates such as handbags being possible without departing from the scope of the invention as defined in the following claims.

What is claimed is:

1. A fastening element capable of providing a user-changeable ornamental appearance on a wearable substrate when worn; in combination with the wearable substrate, the wearable substrate being selected from shoes, sneakers, and sandals, wherein the fastening element is comprised of:

i) a non-functional ornamental section and a separate locking fastening mechanism member, with the locking fastening mechanism member being non removably fixedly attached to a viewably exposed outer surface of the substrate and the non-functional ornamental section is non removably fixedly attached to the locking fastening mechanism member, wherein the non-functional ornamental section is externally visible and the locking fastening mechanism member is concealed and positioned between the non-functional ornamental section and the substrate, with the non-functional ornamental section providing a first ornamental appearance on the outer surface of the substrate when worn;

ii) at least one separate removably fastenable interchangeable ornament, with each of the at least one removably fastenable interchangeable ornament being comprised of an ornamental side and a fastening element, with the fastening element of each of the at least one separate removably fastenable interchangeable ornament being configured to cooperatively be removably lockingly fastened to the locking fastening mechanism member, with each of the at least one removably fastenable interchangeable ornament being configured to be separately, selectively placed on the outer surface of the substrate and on top of the non-functional ornamental section;

wherein placement of one of the at least one separate removably fastenable interchangeable ornament on the outer surface of the substrate and on top of the non-functional ornamental section, the locking fastening mechanism member is configured to cooperatively be removably lockingly fastened to the fastening element of the one removably fastenable interchangeable ornament, with the fastening element of the one removably fastenable interchangeable ornament being configured to be positioned between the non-functional ornamental section and the outer surface of the substrate for direct connection with the locking fastening mechanism member;

wherein cooperative fastening of the fastening element of the one removably fastenable interchangeable ornament and the locking fastening mechanism member, the one removably fastenable interchangeable ornament is thereby positioned, seated and held in a fixed position to cover and conceal all of the locking fastening mechanism member, the fastening element of the one selectively placed removably fastenable interchangeable ornament, the cooperative fastening of the fastening element of the one removably fastenable interchangeable ornament to the locking fastening mechanism member, and the non-functional ornamental section;

wherein the ornamental side of the one removably fastenable interchangeable ornament is thereby positioned in the same direction as the non-functional ornamental section, as externally visible on the viewably exposed outer surface of the substrate to thereby provide a second user-changeable ornamental appearance when worn; and wherein the substrate is externally viewable with either the non-functional ornamental section providing the first ornamental appearance when worn, in the absence of the at least one separate removably fastenable interchangeable ornament, or with the one of the at least one removably fastenable interchangeable ornament providing the second user-changeable ornamental appearance when worn, with the cooperative fastening of the locking fastening mechanism member and the fastening element of the one removably fastenable interchangeable ornament.

2. The fastening element of claim 1, wherein the locking fastening mechanism member comprises releasable engaging, protruding and recessed detent elements for releasable fastening engagement with the fastening element of the interchangeable ornament, the fastening element having a cofitting releasable engaging, protruding and recessed detent fastening structure.

3. The fastening element of claim 2, wherein the detent elements of the locking fastening mechanism member, are hidden from external view by the ornamental section and wherein the detent elements of the locking fastening mechanism member are laterally accessed by the cofitting detent structure of the fastening element of the interchangeable ornament.

* * * * *